US005862230A

United States Patent [19]

Darby

[11] Patent Number: 5,862,230

[45] Date of Patent: Jan. 19, 1999

[54] METHOD TO REDUCE PERCEIVED SOUND LEAKAGE BETWEEN AUDITORIUMS IN MULTIPLEX THEATERS

[76] Inventor: Ronald A. Darby, 44-401 Kaneohe Bay Dr., Kaneohe, Hi. 96744

[21] Appl. No.: 787,387

[22] Filed: Jan. 22, 1997

[51] Int. Cl.[6] ..... H04R 29/00

[52] U.S. Cl. ..... 381/56

[58] Field of Search ..... 381/56, 58, 94.1, 381/73.1, 77; 181/30

[56] References Cited

U.S. PATENT DOCUMENTS 5,751,819 5/1998 Dorrough ..... 381/56

*Primary Examiner*—Vivian Chang

[57] ABSTRACT

A method to improve the enjoyment of a motion picture presentation in a given auditorium located in a multiplex theater complex by controlling the times of sound leakage events from adjacent auditoriums such that the events occur when the sound level from the film in said auditorium is sufficient to completely, or partially, mask the sound leakage events. This is accomplished by providing a means so theater operators can readily schedule the locations of films in auditoriums and their start times based upon the sonic compatibility between the films to be presented on a given day using quantitative ratings incorporating the potential overall intrusiveness of a film as well as its vulnerability to incur perceptible noise due to sound leakage from adjacent auditoriums. An apparatus comprising sensors (1) in the film projectors (2) to sense film start times, data transmission lines to the processor (4), and a processor (4) with memory storing potential sonic compatibility data for selected films and projector start times, calculates and actuates displays (5) showing real time and predicted sonic compatibility information. Also an apparatus with switching means (6) to automatically start, or prohibit starting, a projector (2) when the sonic compatibility between films is favorable, or unfavorable, respectively.

8 Claims, 5 Drawing Sheets

METHOD TO REDUCE PERCEIVED SOUND LEAKAGE BETWEEN AUDITORIUMS IN MULTIPLEX THEATERS

BACKGROUND—FIELD OF INVENTION

This invention relates to improving the enjoyment of motion picture presentations in multiplex theater complexes, specifically to controlling perceptible sounds leaking from adjacent auditoriums during simultaneous presentations.

BACKGROUND—DESCRIPTION OF PRIOR ART

There is a trend to build multiplex motion picture theater complexes consisting of many auditoriums which operate many different film presentations simultaneously. Obviously there is the potential of the sounds from one presentation disturbing the audience in adjacent auditoriums. Designs of new complexes usually specify high quality acoustic common walls separating the auditoriums—often involving non-connecting double walls each with several layers of gypsum board separated by an airspace filled with acoustic insulation. Also designers usually specify acoustic caulking of all joints and utilize independent air-handling systems or special ducting to contain the sound in one auditorium. Despite these efforts to provide acceptable sound isolation between auditoriums, there is an increase in the number of complaints from audiences being annoyed by hearing sounds leaking from adjacent auditoriums.

The main reasons for the problem are the following trends to improve cinema sound systems:

(a) the increase in sound levels available for extended deep bass (low-frequency) information and special effects, such as 105 dB at 20 to 80 Hz representing cannon fire, rocket launches, explosions, etc. These developments are largely due to the use of digital sound techniques in the making of the film sound tracks coupled with the use of more effective subwoofer speakers and amplifiers in the auditoriums;

(b) the ability of properly aligned digital sound systems to "pull" the audience into the movie with multi-channel surround sound allowing the audience to perceive the sound sources "moving around" the theater. This development utilizes the precedence [or Haas] effect wherein one's hearing system locates the source of sound as being in the direction from which it first arrives.

(c) digital soundtracks can have a very wide dynamic range (e.g. 95 dB or more) and, in an ideal auditorium, can effectively present subtle timing and tonal variations by the actor during very quiet passages as well as undistorted roars, blasts and rumbles for high action excitement during intensely loud passages.

(d) the trend to provide very quiet air-handling systems such that the quiet passages in the soundtrack are not masked.

Coupled with the trend to present greater sound energy at low-frequencies, there is the basic fact that low-frequency (bass) sonic energy passes much more readily through the common walls than does mid-and-high frequency (treble) energy. The low-frequency sounds leaking through the wall may cause masking of the information at higher frequencies, e.g. whispers or quiet conversations at critical times. The low-frequency sounds leaking through the walls also may ruin the ambiance designed to simulate the acoustical feel of the filmed location, e.g. gentle rain falling on leaves; it may startle some persons during a quiet passage in their film; and it may distract ones attention in aurally following the distant airplane "circling around the theater" as heard from the surround speakers.

The trend to further utilize, and upgrade, surround speakers mounted directly on the common walls means higher acoustic energy levels exist at the walls. Intense sound levels at higher frequencies (say 2,000 to 4,000 Hz) more readily pass through double walls constructed of gypsum board due to a phenomenon called the transmission loss "coincidence" effect. Such sound leakage may cause direct masking and distractions during quiet times in the presentation.

Higher levels of background noise from the air-handling system can mask the sound leaks from the adjacent auditoriums. However, such higher background levels also mask the dialogue and subtleties in the soundtrack of the film being watched if they are presented at the very quiet sound levels that were intended to recreate the acoustic feel of the filmed location. Raising the film's overall sound level above the background noise levels may not only reduce the ambiance of the quiet passages, but may also cause excessive sound levels when loud passages occur. It is to be noted that total absence of background noise is also undesirable because it makes sound leakage from the adjacent auditoriums too apparent during the quiet passages.

Prior art to resolve these problems involves building, or retrofitting, new improved common walls to better contain the rapidly increasing sound levels available from the new recording formats and superior playback systems. However, basic laws of physics and economics limit the progress which can be gained by wall construction techniques, e.g. higher density solid concrete, independent walls with larger separating spaces mean high initial construction costs as well as reducing seating space within the auditoriums. Also problems exist in flanking paths where low-frequency vibratory energy is "telegraphed" through the floor, roof, and ceiling systems. The costs of retrofitting the party walls of older theater complexes, which were designed to contain the sounds of much inferior recording formats and sound systems, is large in terms of both constructions costs and down times.

Because of the above revelations, film presentations in many multiplex cinema complexes may not provide audiences the full range of visceral effects that are available from the soundtracks. Either the sound systems are adjusted to produce lower sound levels or the new, improved sound system components which are available, are simply not implemented in many auditoriums in multiplex theaters.

OBJECTS AND ADVANTAGES

Accordingly, several objects or advantages of my invention are:

(a) to provide the discerning moviegoer with the experiences that modern developments in cinema sounds offer such as the ambiance and being "pulled" into the movie with multi-channel surround sound to experience the acoustic feel of the filmed location during extremely quiet times without being distracted and annoyed by sound leaking from the adjacent auditorium during loud events in that presentation.

(b) to provide a means for multiplex cinema theater owners and operators to improve the perceived sound in presentations by implementing a control that they already have; that is, to make meaningful decisions on choosing optimum auditorium locations for presenting specific films and acceptable start times of film presentations by using this novel method to resolve the extremely complicated problem of perceived noise leaks between adjacent auditoriums;

(c) to provide a cost effective alternative for cinema theater owners and operators to upgrade the quality of sound in movie presentations by reducing the perceived sound leaks from the adjacent auditoriums without extensive architectural retrofits or new construction;

(d) by providing a means for reducing the perceived sound leaks between adjacent auditoriums, there is a greater probability that motion picture directors and sound engineers (as well as the developers and manufacturers of improved cinema sound system formats and components) will have audiences experience the special bass effects and the ambiance from the surround speakers that they have made available;

(e) to provide a means for multiplex cinema theater owners and operators to make meaningful decisions on whether or not to upgrade components in the sound systems of all, or selected, auditoriums with optical extended bass modules, digital systems; more effective subwoofers and amplifiers, etc. by comparing the predicted sonic incompatibility ratings with existing vs. upgraded components based on sound tracks from cinema productions that they are acquainted with. Similarly, evaluations of upgrading the common walls and acoustic flanking paths can be made using sonic compatibility ratings.

DRAWING FIGURES

DESCRIPTION—FIGS. 1 TO 3

Figure 1:
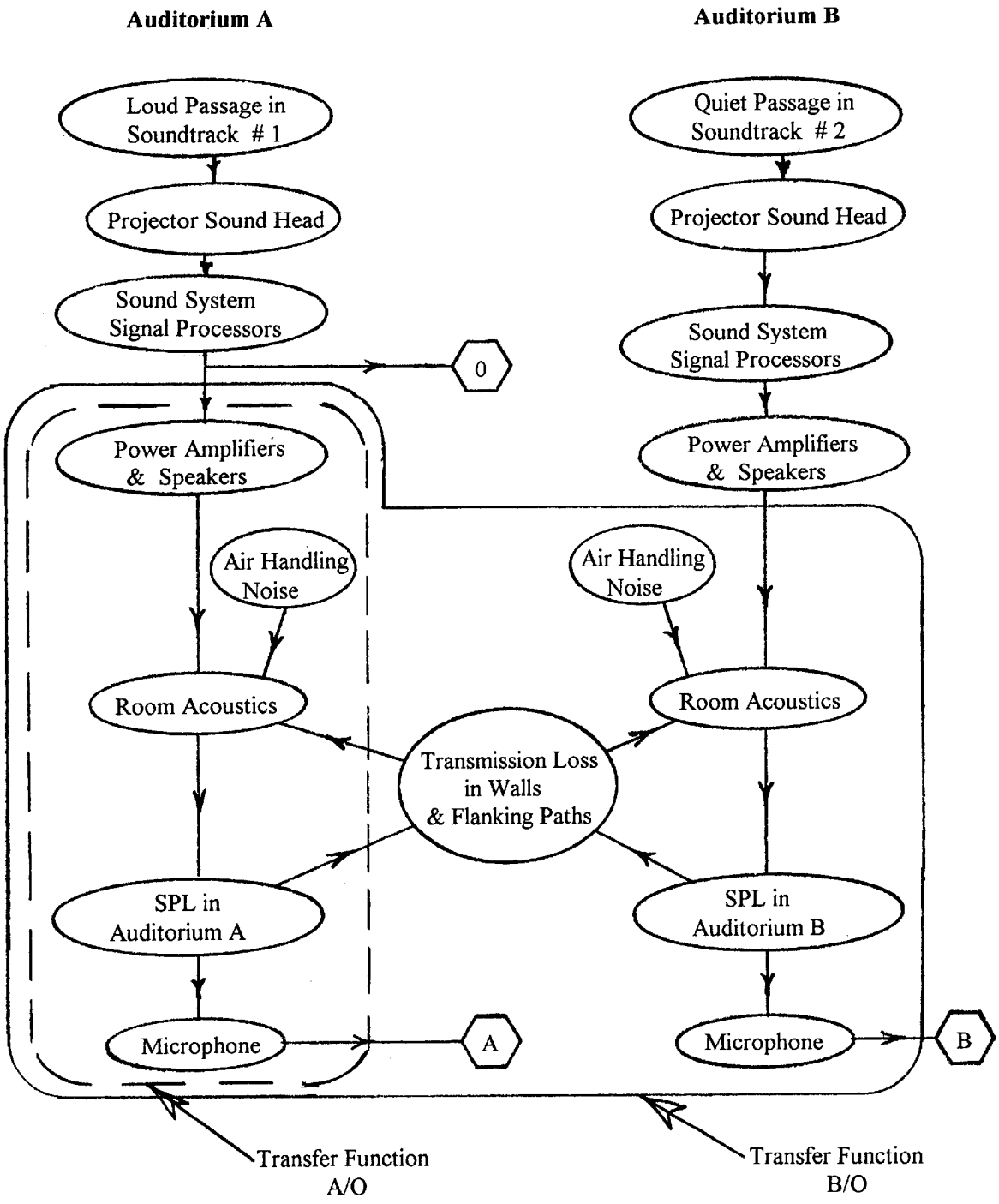
FIG. 1 is a flow diagram of electrical signals being transformed to the sonic signals heard in adjacent auditoriums after being modified by Transfer Functions representing a chain of components in the sound system and phenomena involving the room acoustics and background air handling noise of the auditoriums and the sound transmission through the common wall separating the auditoriums.

The overall embodiment of this invention involves controlling the sounds intended to be heard by the audience in auditorium A in FIG. 1 from soundtrack #1 of the film that they are watching such that they mask the unwanted sounds (noise) that the audience hears due to sound leakage from film soundtrack #2 being presented in auditorium B. This is accomplished by analyzing the information in the film soundtracks and the effects of the auditorium sound systems as well as the air-handling noise and room acoustics sufficiently such that an individual soundtrack can be categorized with an "Overall Potential Compatibility Rating". This information is also used to determine the "Interference Ratings" between the two films being presented in adjacent auditoriums. These sonic compatibility ratings provide guidance in optimally locating films and/or their start times in the auditoriums of a multiplex theater complex.

The electrical signals obtained from microphones at locations A and B in FIG. 1 are measured on a common time code while the soundtrack #1 is played in auditorium A with no soundtracks being played in auditorium B or in any other auditorium adjacent to auditorium B.

The signals directly from soundtrack #1 at point 0 in FIG. 1 represent the sounds that were carefully and painstakingly crafted by the film makers with the sole purpose of making the cinema experience as visceral as possible while listening in an ideal auditorium with near perfect acoustics and sound system characteristics. The data analyzed from a microphone in auditorium A at point A represent the wanted sounds the paying customer actually hears in his local theater after being modified by the effects of the sound system (including its alignment), the air-handling system background noise and room acoustics in auditorium A.

The data measured and analyzed from a microphone in auditorium B at point B in FIG. 1 represents the unwanted sounds an audience would hear if there was a presentation in auditorium B during a very quiet passage. The perceived unwanted sounds (noise) are the results of the sound in auditorium A being modified by the sound transmission loss through the party wall and flanking paths as well as the room acoustics and air-handling noise in auditorium B.

Figure 2:
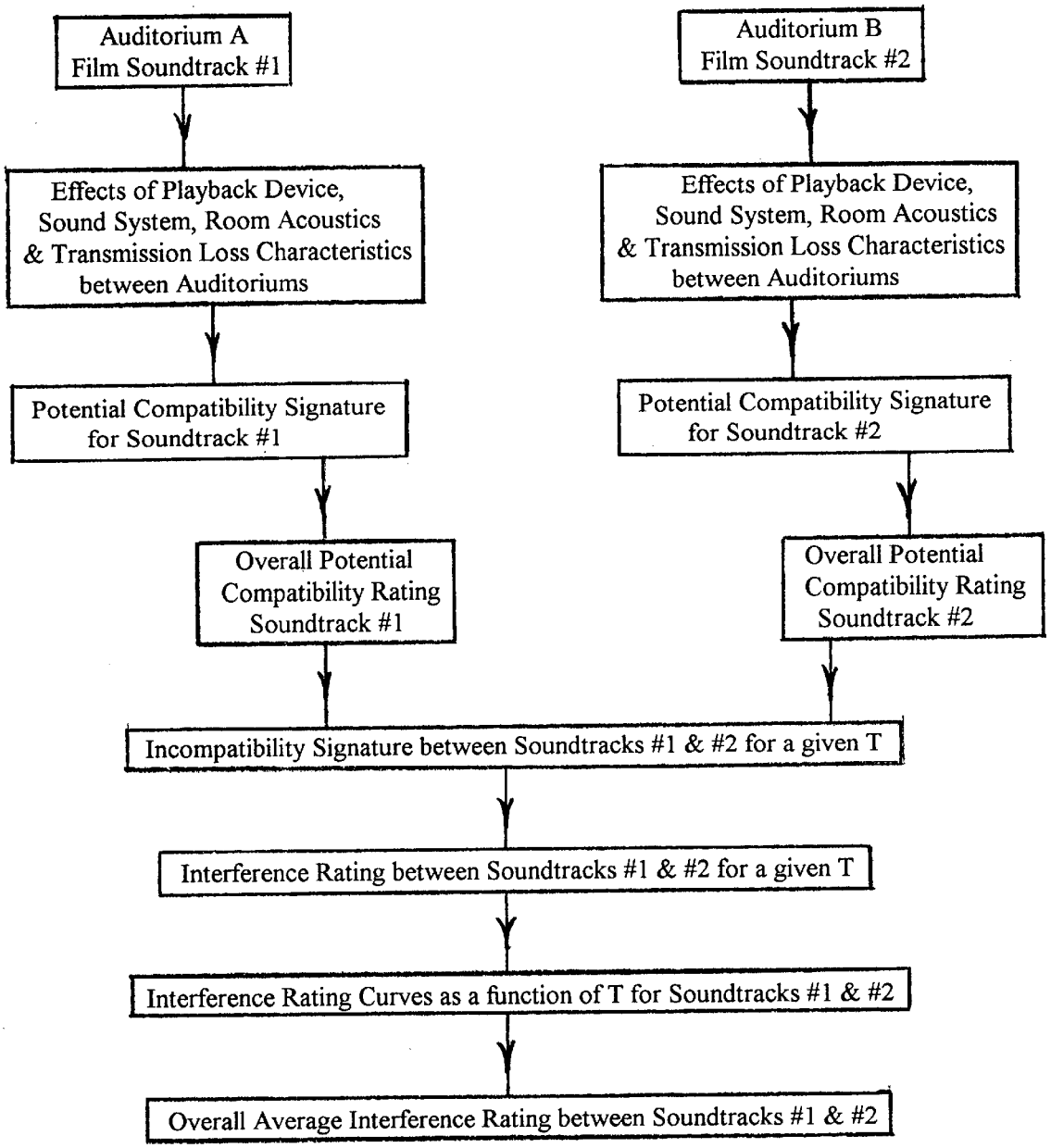
FIG. 2 is a flow diagram relating the sonic information from two film soundtracks being simultaneously presented in adjacent auditoriums to the various sonic compatibility indices.

One specific embodiment of this invention is to define a Potential Compatibility Signature for film soundtrack #1 as shown in FIG. 2, by assigning each portion of the soundtrack a category name representative of the potential sound levels the audiences will perceive in auditorium A and adjacent auditoriums, e.g.:

a) potentially "Intrusive" to the adjacent auditoriums—at the times when relatively high levels of sound were measured in auditorium A;

b) potentially "Vulnerable" to sound leakage from adjacent auditoriums—at the times when low overall sound levels were measured in auditorium A;

c) potentially "Suitable" with adjacent auditoriums—at times when sufficient overall sound levels were measured in auditorium A to completely, or partially, mask sound leakage from adjacent auditoriums, yet not loud enough to be intrusive to the other auditoriums.

Also as shown in FIG. 2, the Overall Potential Compatibility Rating is generated for soundtrack #1 as being potentially Overall Intrusive, Overall Vulnerable or Overall Suitable using the total duration (e.g. in minutes) that was measured in each of the categories—providing multiplex theater operators general guidance in determining which films to present in specific adjacent auditoriums to reduce the probability of annoying sound leakage between auditoriums.

Another specific embodiment of this invention is that after film soundtrack #2 and others are measured and analyzed as above, FIG. 2 shows that a series of Incompatibility Signatures are generated between two given Potential Compatibility Signatures, each for a given film start time difference (T). Each Incompatibility Signature assigns the category of either "Compatible" or "Incompatible" (when one film is Intrusive at times when the other is Vulnerable") over the time period that the two presentations are simultaneously presented. The total time that the films are Incompatible for a given start time difference (T) is called the Interference Rating.

FIG. 2 shows that these data are then used to generate curves of Interference Ratings versus T—showing the total duration (in minutes) of "Incompatibility" (when one film is Intrusive at times when the other is Vulnerable") for various start time differences (T). When properly displayed, this information provides multiplex theater operators with guidance as to the effect of film start times on causing annoying sound leakage between auditoriums. Also, an Average Interference Rating is obtainable representing a single number to evaluate the general sonic compatibility between two films over a given range of differences in start times.

Given a set of films to be shown (and their Potential Compatibility Signatures) in a multiplex theater complex, computations can be automatically made to optimally assign films to specific auditoriums along with optimum start times for each presentation yielding an Optimum Complex Incompatibility Factor for all presentations in the theater complex. This allows theater operators to compare and interact by observing the Complex Incompatibility Factor which would exist for the venue they choose when taking into account such necessary pragmatic factors as customer traffic flow, sales of food and drink, auditorium cleanup times, etc.

As shown in FIG. 1, the sounds from a given soundtrack heard at the local cinema auditorium are the result of the elements within three subsystems: a.) the electronic (and/optical) sound system, b.) the auditorium room acoustics and background noise and c.) the degree of sound isolation between adjacent auditoriums. Though the elements vary widely, they can be grouped together into several categories to meaningfully represent the conditions found in the majority of auditoriums in American multiplex theaters. The sonic compatibility of film soundtracks depend on the characteristics of these subsystems.

The auditorium sound system includes the projector head and all the electronic and optical devices in the theater's A-chain and B-chain involving fixed and variable signal processors as well as amplifiers and speakers. The types of sound systems commonly found in multiplex theaters can be categorized into, say four categories or Groups. A Group I sound system has digital capability, high quality and well aligned signal processors as well as excellent loud speakers and subwoofers. A Group IV sound system may involve an optical soundtrack with analog signals throughout and loud speakers which are less than state-of-the-art. The Potential Compatibility Signature for a given film soundtrack may vary considerably depending on the Sound System Group used in the auditorium.

The sound reproduction capabilities found in auditoriums in today's multiplexes are categorized into, say four classes. The sound pressure level of the background noise in an auditorium is measured and compared to the commonly used Noise Criteria (NC) curves. A Class I auditorium is quiet with the air-handling system producing about NC-25 to NC-30. Reverberation times are a commonly used measurement to determine how quickly a sound impulse decays in a room. The Class I auditorium has low reverberation times and is acoustically dead. A Class IV auditorium has a relatively noisy air-handling system at about NC-50 and is an acoustically lively room with relatively long reverberation times.

Excessive background noise from the air-handling system can mask the dialogue and subtleties in a film soundtrack if presented at the very quiet sound levels that were intended to recreate the acoustic feel of the filmed location. Raising the film's sound level may not only reduce the ambiance of the quiet passages, but also cause excessive sound levels when loud passages occur. However, total absence of background noise is also undesirable because it makes sound leakage from the adjacent auditoriums too apparent during the quiet passages. Thus, the Potential Compatibility Signature for a given film soundtrack may also vary considerably depending on the Class of auditorium in which it is presented.

One means to define the parameters of the various Groups of sound systems and Classes of auditoriums is to utilize an audio post-production mixing theater which is capable of introducing an assortment of the primary elements found in the chain for movie sound reproduction in most of today's theaters. In order to account for all commercial film formats, the theater may have projectors for 35 mm to 70 mm film and audio formats ranging from mono optical to the most recent digital system. The theater may also have a variety of sound system components known to commonly exist in todays multiplex theaters which can be patched-in to duplicate the sound produced by the speakers in typical theaters. The theater also may have means to vary the room acoustics, e.g. changing the reverberation times by rotating elements with a hard surface on one side and a highly absorptive surface on the other. The theater may also have the capability of simulating various levels of the background noise from the air-handling system.

The actual intrusiveness of a given film soundtrack being presented in a given auditorium is also very dependent on the type of common wall between auditoriums. The wall is usually the "weak link" in causing sound to leak from one auditorium to the other. If the sound pressure levels at low frequencies (say from 20 to 200 Hz) are known in auditorium A, reasonable predictions of the sound levels that pass through the wall from special effects involving subwoofers can be made if the construction details of the wall are known. Similarly, reasonable predictions can be made of sound levels at higher frequencies (say 2,000 to 4,000 Hz) that pass through the walls due to the phenomenon of the coincidence effect in gypsum board walls from loud passages using the surround speakers.

The types of common walls utilized in the majority of multiplex theaters are divided into different categories, say four types, based upon the commonly used wall transmission loss index "Sound Transmission Class (STC)". For example, a Type A wall is constructed of non-connecting masonry walls with a large separating space filled with acoustical insulation having STC 65 or greater. A Type D wall is constructed of two layers of gypsum wall board rigidly attached to each side of wooden studs having about STC 45. The wall Type rating and the background noise level chosen in the auditorium Class, will establish the sound level threshold criteria for declaring a passage in the soundtrack as potentially "Intrusive".

From the above, it can be seen that the best case for overall cinema sound presentation exists when auditoriums are Class I and the superior Group I sound system is compatible with Type A walls containing the loud sound events, yet preserving the ambiance desired during quiet passages.

Worst cases exist when digital soundtracks are used with Group I sound systems in quiet Class I auditoriums with poor quality Type D walls causing maximum sound leakage. In many existing multiplex theaters where there are poor quality walls, say Types C or D; also inferior Group III or IV sound systems; and say noisy Class 3 or 4 auditorium ratings, the audience does not experience the intended ambiance during quiet passages nor thrill of deep, extended bass or special subwoofer effects unless sound leakage is perceived in adjacent auditoriums.

Upgrading the sound systems and quieting the air-handling systems causes distracting sound leakage events unless the walls are either also upgraded or the methods described here are implemented. It can be seen that a given film soundtrack will have different Potential Compatibility Signatures (and different Overall Potential Compatibility Ratings) depending upon the sound system Group, the auditorium Class and the common wall Type.

Figure 3:
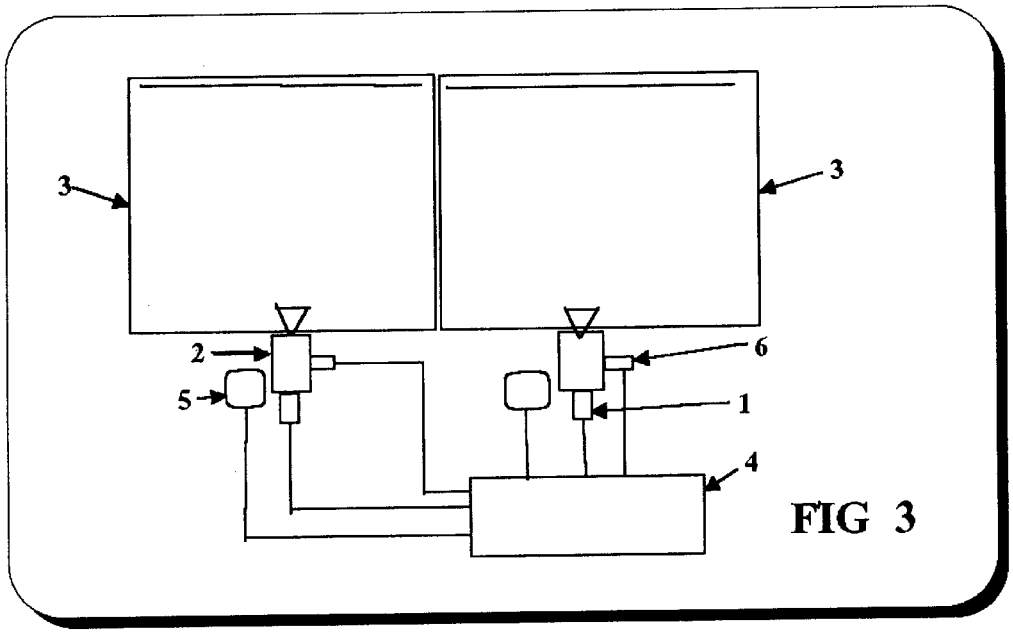
FIG. 3 is a layout showing two adjacent auditoriums with movie projectors containing sensors for obtaining film start times, automatic switches to start the projectors and displays of real time sonic compatibility indices connected to a processor using predetermined film sonic compatibility data.

Another specific embodiment shown in FIG. 3 involves the use of sensors 1 connected to each projector 2 for each auditorium 3 in the complex for the purpose of recording the actual start times of each projector 2 and transmitting that data to the central processor 4 which contains the memory and computational abilities to provide outputs similar to those sited in the above paragraph. However, in this case, displays 5 are provided in the projection room(s) which utilize the actual film start times and allow the projectionists to see the graphs of Interference Ratings versus projector start time within a few minutes of real time so the projectionist can make pragmatic decisions as to when to start the presentation in order to minimize sonic incompatibility between films.

Another specific embodiment shown in FIG. 3 involves providing a switching means 6 for the projectors 2 in order to automatically start a projector 2 within a given time period when the total Interference Rating is below a given threshold between the film about to be started and those films already underway in the adjacent auditoriums 3.

Another specific embodiment shown in FIG. 3 involves providing an automatic switching means 6 for the projectors 2 in order to prevent a projector 2 from starting within a given time period when the total Interference Rating is above a given threshold between the film about to be started and those films already underway in the adjacent auditoriums 3.

OPERATION—FIGS. 1, 3, 4, 5, 6 AND 7

Normally in a multiplex theater complex, there will be a segment containing intermission, trailers, advertisements, previews, etc. common to most film presentations shown simultaneously in the complex. This segment is measured and analyzed in the same manner as the feature film soundtrack and would be the basis for the start time on the time code. The intermission period includes the sounds of cleanup and the background music during seating time for the audience—neither of which are considered Intrusive or Vulnerable. The duration of intermission can often be reasonably adjusted in order to prevent Start Time Differences which cause high sonic Incompatibility between film presentations in adjacent auditoriums.

In many multiplex cinemas, major attractions will be repeated at least 4 to 6 times per day. The optimum Start Time Differences should usually be based on the steady state simultaneous presentations between the first and the last performance. When adjacent showings have staggered start times (T is not=0), the Incompatibility is always less for the first and last performances compared to the other performances because of the lack of audience in one of the auditoriums.

The method to control sonic compatibility between film presentations in a multiplex involves choosing the type of measurement and analysis to be used for the signals available directly from the soundtrack as well as from microphones in the auditoriums. The measurements typically involve use of a standard digital sound level meter which can be interfaced to a personal computer. In any case the signals will be sampled and averaged over an incremental duration of time and related to a time code referenced to the start time of the sound track.

The masking of the unwanted, primarily low-frequency leakage sounds involves direct masking when there are events in the film being observed which involve medium-to-high levels of extended bass or special effects using the subwoofers. At times of low-frequency sound leakage when there are sufficient levels of mid-frequency or high-frequency sound in the film being observed, the phenomenon called remote masking tends to make the audience less aware of the unwanted intruding noise. Also mid-and-high frequency sounds at medium-to-high levels which are closely coupled to the visual presentation tend to direct attention away from the intruding noise. These last two cases are examples when "Suitable" sounds exist in the soundtrack of a film.

The most vulnerable case in sensing the unwanted sounds occurs when there is no sound output from the film being observed and the sound level in the auditorium is controlled by the relatively low level noise from the air-handling system and sometimes sounds from the audience—seat cushion movements and sniffles as well as quiet nervous gasps, laughter and exclamations. This case often occurs when the script is providing a very intense and/or emotional scene causing the distraction and annoyance from the unwanted sound to be magnified. These cases represent "Vulnerable" sounds in the soundtrack.

One method to record and analyze the sounds, which accounts for the required spectral characteristics, is to simultaneously (or alternately) sample at time intervals both the "A" weighted value and the "C" weighted value commonly used in sound level meters. "A" weighted values greatly reduce the effect of sound energy levels at the lower frequencies. If the (C-A) value is calculated for each time increment, the Intrusive events with primarily low-frequency energy can be identified as those when (C-A) exceeds a given threshold, e.g. 10 dB.

Figure 4:
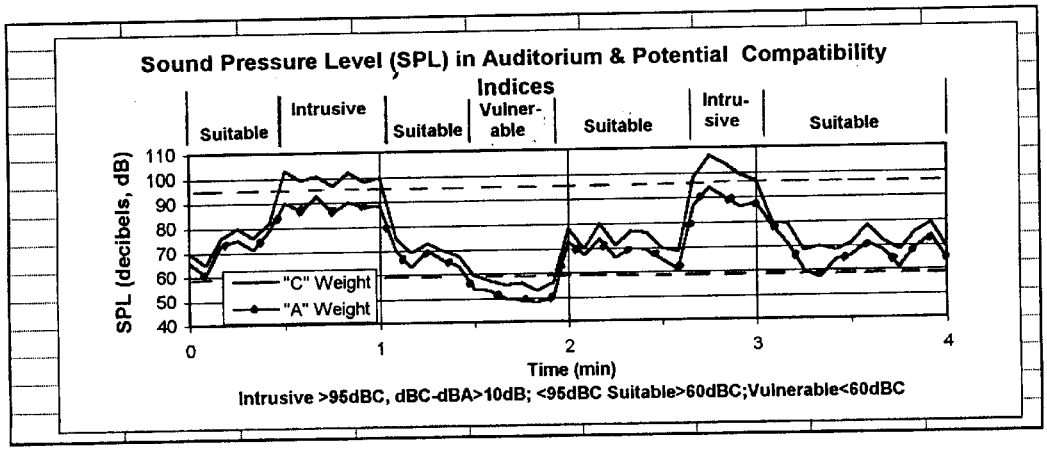
FIG. 4 shows "C" and "A" weighted sound levels versus time (t) for a passage in a soundtrack and the assignment of categories for the Potential Compatibility Signature for that soundtrack when played in an auditorium with a known sound system Group, auditorium Class and common wall Type.

As shown in FIG. 4, potential Compatibility Signatures are developed from each soundtrack using predetermined criteria, e.g.:Intrusive—those C levels exceeding 95 dB and the (C-A) value is greater than 10 dB; Suitable—those C levels between 60 and 95 dB which are not Intrusive and provide acceptable masking of noise leaking from an adjacent auditorium; and Vulnerable—those C levels less than 60 dB. The threshold criteria actually used are independent of the soundtrack and reflect the Class of the auditorium and the Type of the common wall.

Figure 5:
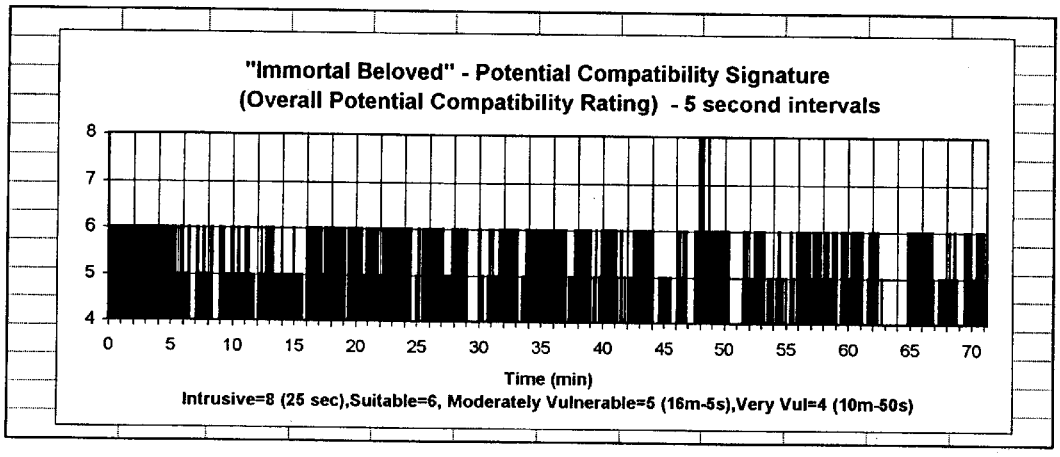
FIG. 5 shows the Potential Compatibility Signatures and the Overall Potential Compatibility Ratings for portions of two film soundtracks.
Figure 5:
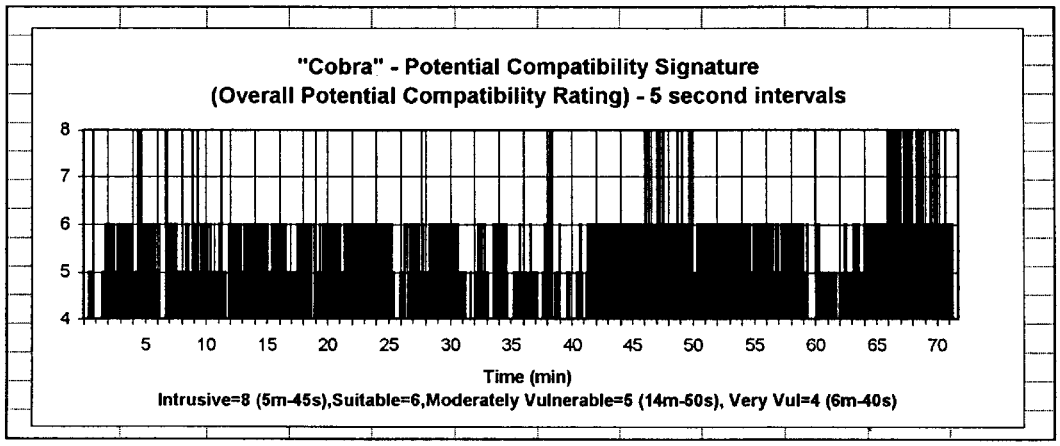

FIG. 5 shows Potential Compatibility Signatures for portions of two film soundtracks where 5 second interval samples were obtained and classified as Intrusive, Suitable or Vulnerable (note two categories of Moderately Vulnerable and Very Vulnerable were used). Also shown in the figure are the Overall Potential Compatibility Ratings, e.g. "Immortal Beloved" has only 25 seconds of "Intrusive" while "Cobra" has 5 minutes-45 seconds of "Intrusive". "Immortal" has 10 minutes-50 seconds of "Very Vulnerable" while "Cobra" has 6 minutes-40 seconds. From this information it should be concluded that these two films should probably not be presented in adjacent auditoriums because of potential sonic incompatibility.

Figure 6:
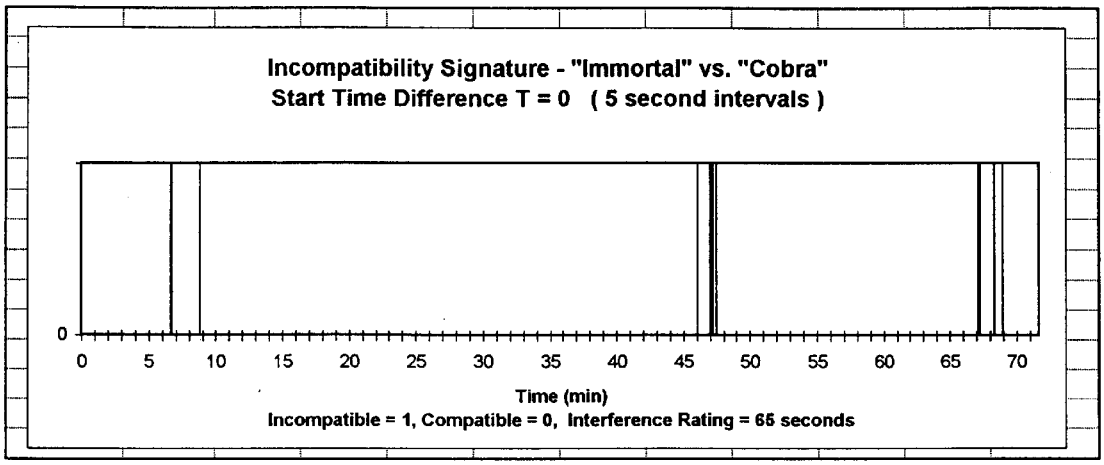
FIG. 6 shows the Incompatibility Signature for Start Time Difference T=0 for the two soundtrack Potential Compatibility Signatures portions shown in FIG. 5 to be presented simultaneously in adjacent auditoriums.

From FIG. 5 one can perceive how the Incompatibility Signatures are utilized for two films to be presented in adjacent auditoriums classifying their sonic compatibility as either "Incompatible" or "Compatible" at any given time (t). There will be a unique Incompatibility Signature for a given Start Time Difference (T), e.g. as shown in FIG. 6 for the same start times where T=0. The total duration that one film causes Incompatibility with the other is also unique for a given start time difference and is called the Interference Rating. In FIG. 6 it can be seen that the Interference Rating for T=0 is 65 seconds for the example.

From FIGS. 5 and 6, one can see that when an Intrusive event on one soundtrack occurs at the same time t with a Vulnerable event on the other soundtrack, the Incompatibility Signature for those two soundtracks would register an "Incompatible" event for that 5 second interval. All other combinations of events may be considered Compatible, e.g. Intrusive to Intrusive: Intrusive to Intermission; Intermission to all categories; as well as Suitable or Vulnerable to Suitable, Vulnerable, and Intermission.

Figure 7:
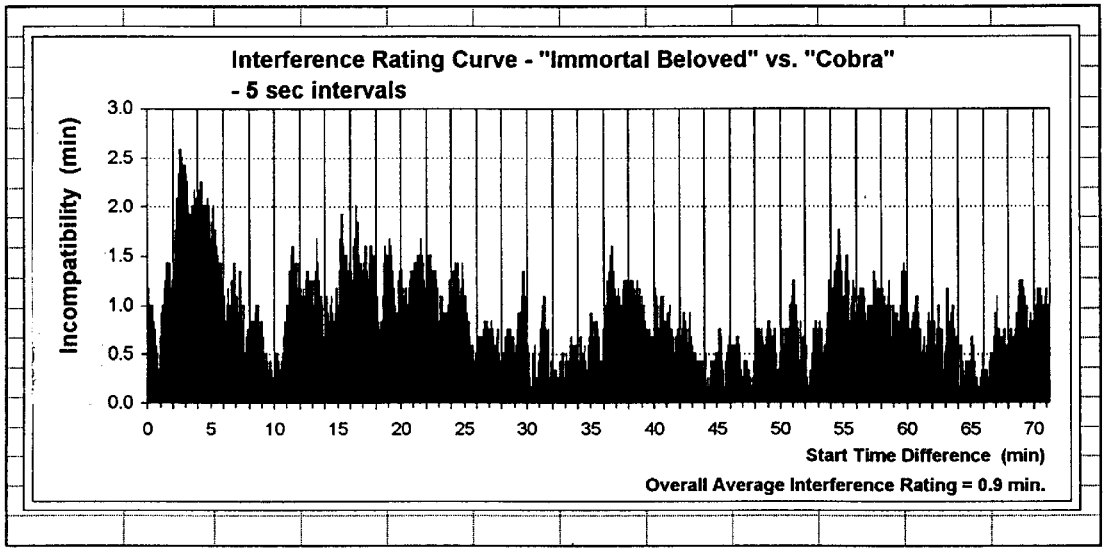
FIG. 7 shows the curve of Interference Ratings versus Differences in Start Times (T) and the Overall Average Interference Rating for the two film soundtrack portions shown in FIG. 5 to be presented simultaneously in adjacent auditoriums.

FIG. 7 shows curves of Interference Ratings plotted versus Start Time Differences (T) obtained from the two signatures shown in FIG. 5. From FIG. 7 it can be seen that if "Immortal" starts about 3 minutes after "Cobra", there would be a total of 2 minutes-36 seconds of Incompatibility between the performances. It can also be seen that by starting "Immortal" about 10 minutes after "Cobra"—a total of only 15 seconds of Incompatibility would occur. Thus by adjusting the start time schedule by about 7 minutes, the sound leakage between presentations is reduced by a factor of 10.

Because it may not be possible to start a projector at the precise optimum time, a single number Average Interference Rating can be obtained from FIG. 7 dividing the area under the curve by a selected range of Start Time Differences. For example, in the range of T=3 to 5 minutes, the average total time of intrusions is 2 minutes-12 seconds; while in the range of T=9 to 11 minutes, the average total time of intrusions is only about 20 seconds.

The Average Interference Rating over the entire range of StartTime Differences is called the Overall Average Interference Rating and, as seen in FIG. 7, for these two films it is 0.91 minutes. Thus, the sonic Incompatibility for this example ranges from a low of 15 seconds to a high of 2minutes-36 seconds (depending upon the relative start times) with an average of 55 seconds of Incompatibility. This information indicates that it would be risky to present these two films in adjacent auditoriums unless the start times are properly controlled.

If the processor is connected to start time sensors in the projectors as shown in FIG. 3, proper processor and display design utilizing the actual film start times will allow the projectionist to zoom in on the graphs of Interference Ratings within a few minutes of real time and make pragmatic decisions as to when to start a new presentation in order to minimize sonic incompatibility with the ongoing films) in adjacent auditoriums.

It is not necessary to make actual sound level measurements in auditoriums in order to obtain meaningful sonic compatibility ratings for each film soundtrack. Transfer Functions can be measured in the special cinema theater mentioned above and used to estimate the effect of the different elements involved in the chain. The projector head shown in FIG. 1 is removed and replaced by artificial noise sources in each track at point 0. Transfer Functions A/0 are developed for all sound system and auditorium acoustical room effects for the different auditorium Classes by ratioing data from point A to the data from point 0. The background noise effect is either included directly in the measurements in the special theater or proper NC levels for each Class are separately added later in the simulator described below.

Similarly using FIG. 1, a Transfer Function B/A is developed from measurements or empirical calculations for the sound leakage effects between two auditoriums separated by a common wall for the different wall Types by ratioing data from point B to the data from point A. Again, the background noise effect is either included directly in the measurements in the special theater or proper NC levels for each Class are separately added later in the simulator described below.

An analog and/or digital simulator is then constructed with input tracks that are compatible with the projector head such that when a soundtrack is played into the simulator. When a film sound track is played through the projector head into the simulator, the simulator provides a single output with a signal similar to that obtained from a microphone in auditorium A for a given auditorium Class and a single output with a signal similar to that obtained from a microphone in auditorium B for a given wall Type. After determining the threshold criteria for the various combinations of sound system Group, auditorium Class and wall Type; Potential Compatibility Signatures can be obtained for a given sound track that can be used in most of the multiplex theaters in existence. The construction of such simulators is well within the state-of-the-art for engineers engaged in cinema sound system development.

CONCLUSIONS, RAMIFICATIONS AND SCOPE

Thus the reader can see that methods to reduce perceived sound leakage between auditoriums in multiplex theaters will allow moviegoers to experience state-of-the-art developments in cinema sounds. This is accomplished by providing a means to schedule the start times and locations of films such that sound leakage events occur when the sound level from the film being shown in an auditorium is sufficient to completely, or partially, mask the sound leakage events from the adjacent auditorium. Furthermore, the methods have the advantages of:

- providing a cost effective alternative to cinema theater owners and operators for upgrading the quality of perceived sound in multiplex movie presentations without extensive architectural retrofits or new construction;
- by providing a means for reducing the perceived sound leaks between adjacent auditoriums, motion picture directors and sound engineers, as well as the developers and manufacturers of improved cinema sound system formats and components, improve the probability of having audiences experience extended deep-bass special effects as well as the ambiance and being "pulled" into the movie with multi-channel surround sound to sense the acoustic feel of the filmed location;
- providing a means for multiplex operators to quickly make decisions on optimum start times of film presentations and locations in the complex utilizing the results from computer programs to reduce perceived noise leaks between adjacent auditoriums;
- providing a means for multiplex cinema theater owners and operators to make meaningful decisions on whether or not to upgrade components in the sound systems (e.g. optical extended bass modules, digital systems; more effective subwoofers, surround speakers and amplifiers, etc.) by comparing the predicted sonic compatibility ratings with existing vs. upgraded components based upon sound tracks from cinema productions that they are acquainted with. Similarly, evaluations of upgrading the party walls and acoustic flanking paths can be made using sonic compatibility ratings.

providing an apparatus to record the actual start times of projectors and to transmit that data to a processor which incorporates the data into the calculations of sonic compatibility so judgments can be made in real time for optimal start times of projectors and to also document the operations for post facto evaluation and comparisons.

providing a switching means for the projectors in order to automatically start a projector within a given time period when the total Interference Rating is below a given threshold between the film about to be started and those films already underway in the adjacent auditoriums.

providing an automatic switching means for the projectors in order to prevent a projector from starting within a given time period when the total Interference Rating is above a given threshold between the film about to be started and those films already underway in the adjacent auditoriums.

Although the description above contains many specificities, these should not be construed as limiting the scope of the invention but as merely providing illustrations of some of the presently preferred embodiments of this invention. For example:

the analysis of signals from soundtracks or microphones could involve other techniques to account for spectral considerations rather than the "A" and "C" weighting factors, such as using filters with fixed bandwidths to sense low-frequency information and/or to generate other indices to represent masking noise;

the analysis of signals from soundtracks or microphones could involve other techniques to account for temporal considerations, for example using statistical indices, such as the sound level exceeded 1% of the time, or 90% of the time, in a given time interval;

incorporating a computer program which requires the following data as input for a given multiplex cinema theater complex: the number of auditoriums, the listing of auditoriums sharing common walls, and a listing of the auditorium Classes and the common wall Types. The other inputs are the sonic compatibility characteristics of individual soundtracks, e.g. the Potential Compatibility Signatures or the Potential Compatibility Ratings; or for all possible pairs of all the films that will be presented simultaneously in the complex, e.g. the Interference Rating Curves or the Average Interference Rating. The results from this program are used by the theater operator for guidance in planning and matching films for sonic compatibility in all auditoriums within the complex.

instead of providing the simulator for the chain of elements in cinema sound presentation mentioned above, an alternate method is to utilize a high quality video tape or compact disc recording of a film soundtrack recorded in a Class I auditorium and make copies modifying the frequency content and levels at Intrusive and Vulnerable passages to simulate the other Classes of auditoriums. The Potential Compatibility Ratings for the various combinations of auditorium Classes and wall Types are then produced from the recordings.

utilize home video cassettes of cinema productions in VCRs instead of actual film soundtracks to determine the sonic compatibility of a film.

other names for the sonic compatibility indices may be used.

the measurement and analysis of signals from soundtracks or microphones could involve other techniques such as a simple sound level meter in conjunction with a graphic level recorder and the resulting charts could be analyzed for sonic compatibility.

Thus the scope of the invention should be determined by the appended claims, rather than by the examples given.

I claim:

1. A method to improve the enjoyment of motion picture presentations in multiplex theater complexes by eliminating, or reducing, the annoying and distracting sounds due to sound leakage between an auditorium and an adjacent auditorium by providing a means so theater operators can predict and, to a considerable extent, control the times when very loud passages in the said auditorium coincides with a very quiet passage in the adjacent auditorium causing perceptible sound leakage; the said method involves:

a) measuring and analyzing the electrical signals outputed from playback devices for soundtracks from motion picture films in terms of averaged sound power spectra over small time intervals, and b) establishing sound pressure level thresholds for defining very loud and very soft by measuring the transfer functions involved in the said theater's electronic sound system, the room acoustics in both auditoriums, the background noise in both auditoriums and the degree of sound isolation between the adjacent auditoriums, and c) creating potential sonic compatibility indices for individual film sound tracks and actual sonic incompatible ratings for pairs of films to be presented simultaneously in the adjacent auditoriums.

2. The method of claim 1 including modifications to the direct measurements obtained from playback of a given soundtrack based on empirical calculations providing transfer functions for different generic components in an auditorium's sound system, optical or digital, and for different generic auditorium room acoustics and background noise as well as different generic party walls separating the auditoriums allowing most cinema auditoriums in existing multiplex theater complexes to be categorized such that film soundtracks can be usefully rated in terms of sonic compatibility.

3. The method of claim 1 including the use of transfer factors for new, or modified elements, e.g. switching from optical to digital systems and to new, more powerful subwoofers, or upgrading party walls separating auditoriums allowing multiplex theater operators to predict and evaluate the sonic compatibility in terms of known motion pictures in adjacent auditoriums.

4. A method to eliminate, or reduce, undesired perceived sounds leaking into a given auditorium from films being simultaneously presented in an adjacent auditorium located in a multiplex theater complex by controlling the times of the sound leakage events from the adjacent auditorium such that the events occur when the desired sounds from the film in the given auditorium are sufficiently loud to completely, or partially, mask the said sound leakage events involving:

establishing a time code for each film presentation including the main feature, intermission as well as features occurring before the main feature, e.g. trailers, advertisements, coming attractions, etc.;

obtaining sound pressure level measurements synchronized to the time code during the total presentation of each film in the said given auditorium and simultaneously in the said adjacent auditorium while there is no film presentation in the said adjacent auditorium;

utilizing the sound pressure level measurements, creating a potential compatibility signature for each film presentation by assigning each passage a category name representative of the potential sound levels the audience will perceive in the auditoriums, e.g.:

a) intrusive passages which are very loud with high sound levels, particularly sounds dominated with low-frequency energy; which can potentially leak into the adjacent auditorium;

b) vunerable passages which are very quiet with low overall sound levels and potentially may allow the audience to perceive sound leakage from the adjacent auditorium;

c) suitable passages which have sufficient overall sound levels to completely, or partially, mask sound leakage from the adjacent auditorium, yet not loud enough to be intrusive to the adjacent auditorium, and ranking each film's potential compatibility signature with an overall potential compatibility rating as being potentially overall intrusive, overall vulnerable or overall suitable using the total duration, e.g. in minutes, that was measured in each of the categories in order to provide multiplex theater operators general guidance in determining which films to present in specific adjacent auditoriums to reduce the probability of annoying sound leakage between auditoriums, and providing interference ratings between two given film potential compatibility signatures as a function of the difference between the film start times, such as curves showing the total duration in minutes of incompatibility when one film is intrusive at times when the other is vulnerable for various different start times and thus providing multiplex theater operators guidance as to the effect of film start times on causing annoying sound leakage between auditoriums, and providing average interference ratings or overall average interference ratings wherein a single number expresses the average value from an interference rating curve for a given range of start time differences, or for the total range, respectively; and allows the multiplex operator to rapidly access the degree of sonic compatibility between two films to be presented in adjacent auditoriums, and providing audiences in multiplex theaters the opportunity to experience the intended ambiance created by the film makers and sound system equipment developers during quiet, emotional passages in a film presentation without perceiving distracting and annoying sounds from loud passages in presentations in adjacent auditoriums.

5. The method of claim 4 including the sound pressure level measured a given auditorium during an actual presentation with a live audience in order to account for the effect of the said auditorium's sound system, room acoustics and construction as well as the audible output of the audience.

6. Apparatus for determining and displaying the interference rating as a function of start time differences between the various film soundtracks to be presented in the various auditoriums in a multiplex theater complex comprising:

processor means with memory for storing the data correlating predetermined potential compatibility signatures as a function of time t, with predetermined film soundtracks to be presented in the complex, sensing means connected to each projector for recording the actual start times for each soundtrack, data transmission means connecting the sensing means to the processor means for communicating the actual start times to the processor means, processor means connected to the data transmission means for generating data representing interference ratings, i.e. the times when one film is intrusive when the other is vulnerable, by analyzing the potential compatibility signatures, i.e. the soundtrack categorized as potentially intrusive, vulnerable or suitable, for the films to be presented in adjacent auditoriums in response to receiving the actual start time from the sensing means attached to a projector for a given film in a given auditorium, data display means connected to the processor means for displaying graphs or other displays of interference ratings versus start time differences including an indication of the current interference rating, involving one or more adjacent auditoriums, as well as the interference rating which will occur within the next several minutes allowing the projectionist to make judgments as to when to optimally start a projector in an auditorium adjacent to an auditorium, or auditoriums, which has a presentation, or presentations, underway.

7. The apparatus of claim 6 including a switching means for the projectors in order to automatically start a projector within a given time period when the interference rating is below a given threshold between the film about to be started and those films already underway in the adjacent auditoriums.

8. The apparatus of claim 6 including an automatic switching means for the projectors in order to prohibit a projector from starting within a given time period when the interference rating is above a given threshold between the film about to be started and those films already underway in the adjacent auditoriums.

* * * * *